US005845624A

United States Patent [19]

Ajima

[11] Patent Number: 5,845,624

[45] Date of Patent: Dec. 8, 1998

[54] AIR-FUEL RATIO CONTROL SYSTEM FOR INTERNAL COMBUSTION ENGINE

[75] Inventor: Takumi Ajima, Zama, Japan

[73] Assignees: Matsushita Electric Industrial Co., Ltd., Osaka; Honda Giken Kogyo Kabushiki Kaisha, Tokyo, both of Japan

[21] Appl. No.: 763,490

[22] Filed: Dec. 11, 1996

[30] Foreign Application Priority Data

Dec. 13, 1995 [JP] Japan ..... 7-324696

[51] Int. Cl.[6] ..... F02D 41/14; F02D 41/30

[52] U.S. Cl. ..... 123/494; 123/694

[58] Field of Search ..... 123/478, 480, 123/490, 494

[56] References Cited

U.S. PATENT DOCUMENTS

| | | | |
|---|---|---|---|
| 4,190,022 | 2/1980 | Long | 123/490 |
| 4,869,222 | 9/1989 | Klassen | 123/673 |
| 4,903,669 | 2/1990 | Groff et al. | 123/478 |

FOREIGN PATENT DOCUMENTS 5-180040 7/1993 Japan .

*Primary Examiner*—Andrew M. Dolinar
*Attorney, Agent, or Firm*—Lowe Hauptman Gopstein Gilman & Berner

[57] ABSTRACT

In an air-fuel ratio control system for an internal combustion engine, a fuel injection amount to be injected from a fuel injector is set based on a monitored operating condition of the engine. The fuel injector injects a corresponding amount of fuel to the engine. An air-fuel ratio sensor monitors exhaust gas discharged from the engine and detects an air-fuel ratio. The system derives an injector sensitivity based on a current fuel injection amount and an output of the air-fuel ratio sensor and further derives, as an injector sensitivity deviation, a ratio between the derived injector sensitivity and an injector sensitivity estimated upon designing the system. The system further derives a sensitivity correction term based on the derived injector sensitivity deviation so as to correct the injector sensitivity. The system may also correct an air-fuel ratio sensor sensitivity in a similar manner.

6 Claims, 8 Drawing Sheets

AIR-FUEL RATIO CONTROL SYSTEM FOR INTERNAL COMBUSTION ENGINE

BACKGROUND OF THE INVENTION

1. Field of the Invention

The present invention relates to an air-fuel ratio control system for an internal combustion engine, which aims at reducing harmful components contained in exhaust gas discharged from the engine of an automotive vehicle or the like.

2. Description of the Prior Art

For satisfying the strict regulation of exhaust gas, three way catalytic converters have been generally used in gasoline-engine vehicles for exhaust gas purification. As is known, the exhaust gas purification characteristic of the three way catalytic converter largely changes depending on an air-fuel ratio of an air-fuel mixture supplied to the engine. The air-fuel ratio represents a rate of air relative to fuel in weight. The rate of 14.7 is called a stoichiometric air-fuel ratio. The purification rate of the three way catalytic converter is maximum at the stoichiometric air-fuel ratio, while it is reduced when the air-fuel ratio becomes rich (excess in fuel) or lean (excess in air) with respect to the stoichiometric air-fuel ratio. Accordingly, the air-fuel ratio is basically controlled to converge to the stoichiometric air-fuel ratio.

For achieving this, a fuel injection amount is controlled rather than an amount of the air since the air amount is difficult to control. Specifically, an amount of the air (an amount of oxygen, to be exact) flowing into a cylinder of the engine is estimated based on a pressure within an intake manifold, a throttle opening degree, an intake air temperature, an engine cooling water temperature, an engine speed and an exhaust gas recirculation (EGR) amount, etc. so as to determine a fuel injection amount corresponding to the estimated air amount. In practice, fuel injection amounts for providing the air-fuel ratio of 14.7 are derived in advance through experiments relative to air amount estimating data for estimating air amounts flowing into the engine cylinder, and such relationships are stored in the form of a table or an experimental formula. Thus, in the actual feedforward control, a required fuel injection amount is derived based on the air amount estimating data through look-up of the stored table or through calculation using the stored experimental formula. The fuel injection amount thus derived is called a basic fuel injection amount.

The engine is provided with an $O_2$ sensor or a LAF sensor (linear air by fuel sensor) as an air-fuel ratio sensor. During the given steady operation of the engine, the fuel injection amount is feedback controlled using an output of the air-fuel ratio sensor so as to achieve the stoichiometric air-fuel ratio. Specifically, a feedback controller derives a difference between an air-fuel ratio measured by the air-fuel ratio sensor and the stoichiometric air-fuel ratio and adds it to the basic fuel injection amount.

As is known, the $O_2$ sensor outputs a digital-like signal with respect to the stoichiometric air-fuel ratio, that is, provides a sudden change in output across the stoichiometric air-fuel ratio. Thus, it is relatively unsuitable for the high-accuracy air-fuel ratio control.

On the other hand, the LAF sensor is capable of measuring the air-fuel ratios over the extensive range. In the air-fuel ratio control using the LAF sensor, the so-called lean-burn control, where a target air-fuel ratio is normally set to no less than 20, may be performed for improving the fuel consumption rate, in addition to the stoichiometric air-fuel ratio control where the target air-fuel ratio is set to 14.7. Although a larger control error is acceptable in the lean-burn control as compared with the stoichiometric air-fuel ratio control, an increased control error may cause the abnormal combustion or the increase of NOx concentration in the exhaust gas. Thus, it is desirable to minimize the control error even in the lean-burn control.

The fuel injection is performed by a fuel injector. In general, an electronic controlled injector used in the gasoline engine is of an ON/OFF type wherein a fuel injection amount is controlled by a time period of an ON state of the injector. The injector includes a fuel valve, a spring and a solenoid. When the solenoid is energized, the valve is opened, while otherwise, the valve is closed due to a biasing force of the spring. The injector of this type has an actuator error called a dead time. The dead time includes a time period from a time point of energization of the solenoid to a time point of actual opening of the valve, which works as a plus factor, and a time period from a time point of deenergization of the solenoid to a time point of actual closing of the valve, which works as a ninus factor. In general, the former is greater than the latter so that the dead time reveals a positive value. If there exists the dead time, an actual injected fuel amount does not become proportional to an energization time, but proportional to a time period obtained by subtracting the dead time from the energization time.

In the foregoing air-fuel ratio control, deviation in sensitivity of the injector (deviation in actual injected fuel amount relative to energization time) or deviation in sensitivity of the LAF sensor caused by dispersion in quality of the individual injectors or LAF sensors or caused by aged deterioration thereof has been a large factor of generating an error in the control.

The engine is normally a multi-cylinder engine, which is provided with fuel injectors for the respective cylinders for improving the performance of the engine. Thus, a four-cylinder engine has four fuel injectors. On the other hand, only one LAF sensor is provided in an exhaust pipe downstream of an exhaust manifold in view of cost. Thus, in order to independently control the four injectors, it is necessary to estimate an air-fuel ratio in each of exhaust pipes of the exhaust manifold.

Japanese First (unexamined) Patent Publication No. 5-180040 discloses a technique for estimating an air-fuel ratio for each of engine cylinders from a value of a LAF sensor provided in an exhaust pipe downstream of an exhaust manifold, using an observer. However, since there is a time lag for combustion gas to reach the LAF sensor from each engine cylinder, if lengths of exhaust pipes of the exhaust manifold differ from each other, it is difficult to compensate for dispersion in sensitivity of the respective injectors.

The deviation of the LAF sensor sensitivity causes a problem similar to that caused by deviation in mean sensitivity of the fuel injectors. When the target air-fuel ratio is set to largely deviate from the stoichiometric air-fuel ratio, for example, in the lean-burn control, a large deviation in air-fuel ratio is caused. Specifically, assuming that the deviation of the LAF sensor sensitivity is 10%, an error in measured air-fuel ratio becomes 0.01 at a region deviating from the stoichiometric air-fuel ratio by 0.1, while it becomes 0.8 at a region deviating from the stoichiometric air-fuel ratio by 8. Thus, in the lean-burn control, the air-fuel ratio deviation of about 0.8 is caused due to the LAF sensor sensitivity deviation of 10%.

In order to avoid the foregoing problems, it has been necessary to perform sensitivity measurement and adjustment of the injector or the LAF sensor before installation so as to minimize the initial error, which, however, increases the cost.

SUMMARY OF THE INVENTION

Therefore, it is an object of the present invention to provide an improved air-fuel ratio control system for an internal combustion engine, which is capable of achieving a high-accuracy air-fuel ratio control even if there exists deviation in injector sensitivity or LAF sensor sensitivity.

According to one aspect of the present invention, an air-fuel ratio control system for an internal combustion engine, comprises a fuel injector for injecting fuel to the engine; setting means for setting a fuel injection amount to be injected from the fuel injector; measuring means for measuring an accumulated value of fuel amounts actually injected from the fuel injector; injector sensitivity measuring means for measuring a sensitivity of the fuel injector based on an accumulated value of the fuel injection amounts set by the setting means and the accumulated value of fuel amounts measured by the measuring means; and injector sensitivity correcting means for correcting the sensitivity of the fuel injector, the injector sensitivity correcting means deriving a sensitivity correction value based on the measured sensitivity of the fuel injector such that a sensitivity of a virtual fuel injector constituted by the fuel injector and the injector sensitivity correcting means becomes equal to a preset injector sensitivity.

It may be arranged that the engine is of a multi-cylinder type and provided with fuel injectors for respective cylinders, that the measuring means measures an accumulated value of fuel amounts actually injected from the fuel injectors, that the injector sensitivity measuring means measures a mean sensitivity of the fuel injectors based on the accumulated value of the set fuel injection amounts and the measured accumulated value of fuel amounts, and that the injector sensitivity correcting means derives a sensitivity correction value based on the measured mean sensitivity of the fuel injectors such that a mean sensitivity of virtual fuel injectors each constituted by one of the fuel injectors and the injector sensitivity correcting means becomes equal to the preset injector sensitivity.

According to another aspect of the present invention, an air-fuel ratio control system for an internal combustion engine, comprises a fuel injector for injecting fuel to the engine; an air-fuel ratio sensor provided in an exhaust pipe for monitoring combustion gas discharged from the engine; setting means for setting a fuel injection amount to be injected from the fuel injector; injector sensitivity measuring means for measuring a sensitivity of the fuel injector based on the fuel injection amount set by the setting means and an output of the air-fuel ratio sensor; and injector sensitivity correcting means for correcting the sensitivity of the fuel injector, the injector sensitivity correcting means deriving a sensitivity correction value based on the measured sensitivity of the fuel injector such that a sensitivity of a virtual fuel injector constituted by the fuel injector and the injector sensitivity correcting means becomes equal to a preset injector sensitivity.

It may be arranged that the setting means sets the fuel injection amount based on a preselected engine operation indicative parameter and the output of the air-fuel ratio sensor, that the injector sensitivity measuring means compares the fuel injection amount which is set by the setting means when an air-fuel ratio is controlled at a stoichiometric air-fuel ratio at a given operating state of the engine, with a preset fuel injection amount which provides the stoichiometric air-fuel ratio in the given operating state of the engine with the preset injector sensitivity, so as to derive the sensitivity of said fuel injector based on a ratio therebetween.

It may be arranged that the engine is of a multi-cylinder type and provided with fuel injectors for respective cylinders, that the setting means sets the fuel injection amount based on a preselected engine operation indicative parameter and the output of the air-fuel ratio sensor, and that the injector sensitivity measuring means compares the fuel injection amount which is set by the setting means when an air-fuel ratio is controlled at a stoichiometric air-fuel ratio at a given operating state of the engine, with a preset fuel injection amount which provides the stoichiometric air-fuel ratio in the given operating state of the engine with the preset injector sensitivity, so as to derive a mean sensitivity of the fuel injectors based on a ratio therebetween.

It may be arranged that a deviation in sensitivity of one of the fuel injectors relative to the mean sensitivity is derived by changing the set fuel injection amount for the one of the fuel injectors and by comparing outputs of the air-fuel ratio sensor before and after the change of the set fuel injection amount for the one of the fuel injectors.

It may be arranged that means is provided for monitoring engine speeds to determine whether a variation in engine speed is less than a given value, and that the injector sensitivity measuring means measures the sensitivity of the fuel injector when the variation is less than the given value.

It may be arranged that means is provided for monitoring engine speeds to determine whether a variation in engine speed is less than a given value, and means is provided for monitoring throttle opening degrees to determine whether a variation in throttle opening degree is less than a given value, and that the injector sensitivity measuring means measures the sensitivity of the fuel injector when the variations are both less than the given values.

It may be arranged that means is provided for monitoring engine speeds, means is provided for determining whether a variation in engine speed is less than a given value, and means is provided for determining whether the engine speed is less than a given value, and that the injector sensitivity measuring means measures the sensitivity of the fuel injector when the variation and the engine speed are both less than the given values.

It may be arranged that means is provided for determining whether the engine is in an idling state, and that the injector sensitivity measuring means measures the sensitivity of the fuel injector when the engine is in the idling state as determined by the determining means.

It may be arranged that time measuring means is provided for measuring a given time lapse, and that the injector sensitivity measuring means measures the sensitivity of the fuel injector when the given time lapse is measured by the time measuring means.

It may be arranged that means is provided for feeding a sensitivity measurement start command from exterior, and that the injector sensitivity measuring means measures the sensitivity of the fuel injector when the sensitivity measurement start command is fed from exterior.

It may be arranged that means is provided for determining whether the engine is in a fully warmed-up state, and that the injector sensitivity measuring means measures the sensitivity of the fuel injector when the engine is in the fully warmed-up state as determined by the determining means.

It may be arranged that throttle opening degrees are controlled by an actuator, and the engine is driven at preset speed patterns, and that the injector sensitivity measuring means measures the sensitivities of the fuel injector at a plurality of engine speeds and the injector sensitivity correcting means corrects the sensitivities of the fuel injector based on the measured sensitivities at the plurality of engine speeds, It may be arranged that means is provided for controlling a canister purge valve, and that the injector sensitivity measuring means measures the sensitivity of the fuel injector when the canister purge valve is closed by the controlling means.

It may be arranged that means is provided for controlling a secondary air valve, and that the injector sensitivity measuring means measures the sensitivity of the fuel injector when the secondary air valve is controlled by the controlling means to feed a constant amount of secondary air.

According to another aspect of the present invention, an air-fuel ratio control system for an internal combustion engine, comprises a fuel injector for injecting fuel to the engine; an air-fuel ratio sensor provided in an exhaust pipe for monitoring combustion gas discharged from the engine; setting means for setting a fuel injection amount to be injected from the fuel injector; air-fuel ratio sensor sensitivity measuring means for measuring a sensitivity of said air-fuel ratio sensor based on the fuel injection amount set by said setting means and an output of the air-fuel ratio sensor; and air-fuel ratio sensor sensitivity correcting means for correcting the sensitivity of the air-fuel ratio sensor, the air-fuel ratio sensor sensitivity correcting means deriving a sensitivity correction value based on the measured sensitivity of the air-fuel ratio sensor such that a sensitivity of a virtual air-fuel ratio sensor constituted by said air-fuel ratio sensor and the air-fuel ratio sensor sensitivity correcting means becomes equal to a preset air-fuel ratio sensor sensitivity.

It may be arranged that the air-fuel ratio sensor sensitivity measuring means measures the sensitivity of the air-fuel ratio sensor based on an output of said air-fuel ratio sensor obtained in response to a fuel injection amount set by the setting means and a fuel injection amount preset for providing a stoichiometric air-fuel ratio in a current operating state of the engine.

It may be arranged that the air-fuel ratio sensor sensitivity measuring means measures the sensitivity of said air-fuel ratio sensor based on an output of said air-fuel ratio sensor obtained in response to a fuel injection amount set by the setting means when an air-fuel ratio is not controlled at a stoichiometric air-fuel ratio, and a fuel injection amount set by said setting means in a state where the air-fuel ratio is controlled at the stoichiometric air-fuel ratio.

It may be arranged that the air-fuel ratio sensor sensitivity measuring means measures the sensitivity of the air-fuel ratio sensor based on an output of the air-fuel ratio sensor obtained in response to a first fuel injection amount set by said setting means, and an output of the air-fuel ratio sensor obtained in response to a second fuel injection amount set by said setting means, the first and second fuel injection amounts being different from each other.

It may be arranged that means is provided for monitoring engine speeds to determine whether a variation in engine speed is less than a given value, and that the air-fuel ratio sensor sensitivity measuring means measures the sensitivity of the air-fuel ratio sensor when the variation is less than the given value.

It may be arranged that means is provided for monitoring engine speeds to determine whether a variation in engine speed is less than a given value, and means for monitoring throttle opening degrees to determine whether a variation in throttle opening degree is less than a given value, and that the air-fuel ratio sensor sensitivity measuring means measures the sensitivity of the air-fuel ratio sensor when the variations are both less than the given values.

It may be arranged that means is provided for monitoring engine speeds, means is provided for determining whether a variation in engine speed is less than a given value, and means is provided for determining whether the engine speed is less than a given value, and that the air-fuel ratio sensor sensitivity measuring means measures the sensitivity of the air-fuel ratio sensor when the variation and the engine speed are both less than the given values.

It may be arranged that means is provided for determining whether the engine is in an idling state, and that the air-fuel ratio sensor sensitivity measuring means measures the sensitivity of the air-fuel ratio sensor when the engine is in the idling state as determined by the determining means.

It may be arranged that time measuring means is provided for measuring a given time lapse, and that the air-fuel ratio sensor sensitivity measuring means measures the sensitivity of the air-fuel ratio sensor when the given time lapse is measured by the time measuring means.

It may be arranged that means is provided for feeding a sensitivity measurement start command from exterior, and that the air-fuel ratio sensor sensitivity measuring means measures the sensitivity of the air-fuel ratio sensor when the sensitivity measurement start command is fed from exterior.

It may be arranged that means is provided for determining whether the engine is in a fully warmed-up state, and that the air-fuel ratio sensor sensitivity measuring means measures the sensitivity of the air-fuel ratio sensor when the engine is in the fully warmed-up state as determined by the determining means.

It may be arranged that throttle opening degrees are controlled by an actuator, and the engine is driven at preset speed patterns, and that the air-fuel ratio sensor sensitivity measuring means measures the sensitivities of the air-fuel ratio sensor at a plurality of engine speeds and the air-fuel ratio sensor sensitivity correcting means corrects the sensitivities of the air-fuel ratio sensor based on the measured sensitivities at the plurality of engine speeds.

It may be arranged that means is provided for controlling a canister purge valve, and that the air-fuel ratio sensor sensitivity measuring means measures the sensitivity of the air-fuel ratio sensor when the canister purge valve is closed by the controlling means.

It may be arranged that means is provided for controlling a secondary air valve, and that the air-fuel ratio sensor sensitivity measuring means measures the sensitivity of the air-fuel ratio sensor when the secondary air valve is controlled by the controlling means to feed a constant amount of secondary air.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings. In the following description, without any specific reference to the contrary, "fuel injection time" or "fuel injection amount" represents a time in the unit of millisecond (ms).

Figure 1:
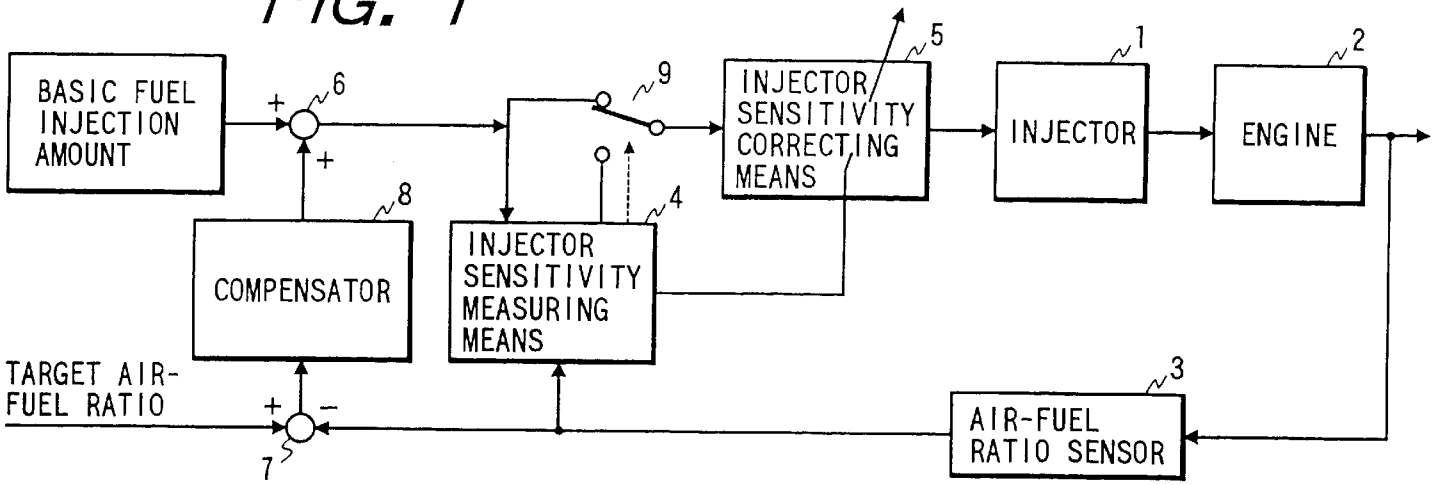
FIG. 1 is a block diagram schematically showing a general structure of an air-fuel ratio control system for an internal combustion engine, which is capable of correcting an injector sensitivity.

FIG. 1 is a block diagram schematically showing a general structure of an air-fuel ratio control system for an internal combustion engine, which is capable of correcting an injector sensitivity. In FIG. 1, numeral 1 denotes injectors for injecting fuel to corresponding cylinders of an engine 2, numeral 3 denotes an air-fuel ratio sensor provided in an exhaust pipe downstream of an exhaust manifold for monitoring an oxygen concentration in the exhaust gas discharged from the engine 2, numeral 4 denotes injector sensitivity measuring means for measuring an injector sensitivity without using an observer, and numeral 5 denotes injector sensitivity correcting means for correcting the injector sensitivity. Further, in FIG. 1, numeral 6 denotes an adder, 7 a subtracter, 8 a compensator and 9 a switch.

In FIG. 1, the components other than the injectors 1, the engine 2 and the air-fuel ratio sensor 3 are constituted by a controller incorporating a microcomputer and peripheral interfaces.

Now, a general operation of the system shown in FIG. 1 will be described hereinbelow.

Based on an engine cooling water temperature, a throttle opening degree, an engine speed and other engine parameters, a basic fuel injection amount is derived in the known manner and fed to the adder 6. As appreciated, the basic fuel injection amount is derived using a stored look-up table, a stored formula or the like in the known manner. During a given steady operating state of the engine 2, a target air-fuel ratio is normally set to the stoichiometric air-fuel ratio. The air-fuel ratio sensor 3 monitors the exhaust gas discharged from the engine 2 to detect an air-fuel ratio of a corresponding air-fuel mixture fed to the engine 2. The detected air-fuel ratio and the target air-fuel ratio are fed to the subtracter 7 where the detected air-fuel ratio is subtracted from the target air-fuel ratio to obtain a difference therebetween. In practice, since each injector has a deviation in sensitivity as an actuator, this difference does not become 0 (zero). A signal indicative of this difference is fed to the adder 6 via the compensator 8 for stabilizing the control system and added to the basic fuel injection amount so that a fuel injection amount is derived at the adder 6. A signal indicative of the derived fuel injection amount is inputted into the injector sensitivity correcting means 5 via the switch 9. The injector sensitivity correcting means 5 sets a sensitivity correction term and multiplies the inputted fuel injection amount by the sensitivity correction term. An initial value of the sensitivity correction term is set to 1. Accordingly, in the initial state, the fuel injection amount derived at the adder 6 is fed to the injector 1 so that fuel is injected through the injector 1 correspondingly. The injected fuel is burned in the corresponding cylinder of the engine 2 and discharged as the exhaust gas.

Upon measurement of the injector sensitivity, the injector sensitivity measuring means 4 derives the injector sensitivity based on the fuel injection amount derived at the adder 6 and fed to the injector sensitivity measuring means 4 and/or the output of the air-fuel ratio sensor 3 fed to the injector sensitivity measuring means 4. If necessary, the switch 9 may be turned downward in FIG. 1 so that the fuel injection amount derived at the adder 6 is only fed to the injector sensitivity measuring means 4, wherein a basic fuel injection amount is derived only for the purpose of the sensitivity measurement and fed to the adder 6. The injector sensitivity measuring means 4 derives a ratio between the derived injector sensitivity and an injector sensitivity estimated upon designing the control system and outputs it to the injector sensitivity correcting means 5 as an injector sensitivity deviation. The injector sensitivity correcting means 5 sets a sensitivity correction term based on the received injector sensitivity deviation so as to correct the injector sensitivity. As a result, assuming that the injector sensitivity correcting means 5 and the injector 1 are put together to form a virtual injector, a sensitivity of the virtual injector becomes equal to an injector sensitivity estimated upon designing the control system. As described above, the fuel injection amount derived at the adder 6 is multiplied by the sensitivity correction term at the injector sensitivity correcting means 5 so as to be fed to the injector 1. The injector sensitivity correcting means 5 updates the sensitivity correction term by multiplying the current sensitivity correction term by a newly derived injector sensitivity deviation fed from the injector sensitivity measuring means 4.

(First Embodiment)

Now, a first preferred embodiment of the present invention will be described hereinbelow, wherein FIG. 1 is applied.

In this embodiment, the injector sensitivity measuring means 4 in the controller derives an injector sensitivity based on a relationship between the fuel injection amount (fuel injection time) derived at the adder 6 and an actual injected fuel amount (cc). As appreciated, the fuel injection amount (ms) derived at the adder 6 is known, while an instantaneous actual injected fuel amount (cc) is difficult to measure. On the other hand, there are some methods which can measure an accumulated value of the actual fuel amounts injected from the injectors 1. Thus, by deriving a ratio between an accumulated value of the fuel injection amounts (ms) derived at the adder 6 and a measured accumulated value of the actual injected fuel amounts, a mean sensitivity of the injectors 1 can be derived. For example, an integrating flowmeter may be provided in a fuel feed pipe to measure a fuel amount (cc) supplied in a given time period and, by dividing the measured fuel amount (cc) by an accumulated value of the fuel injection amounts (ms) derived at the adder 6 in that time period, a mean sensitivity of the injectors 1 can be derived. In this embodiment, the injector sensitivity measuring means 4 accumulates the fuel injection amounts (ms) derived at the adder 6 and monitors data from the integrating flowmeter. Every time an accumulated value of the fuel amounts (cc) reaches 100 cc, the accumulated value (cc) is reset to 0 and a sensitivity measuring process is started. In the sensitivity measuring process, 100 cc is divided by the accumulated fuel injection amount (ms) to derive a mean sensitivity (cc/ms) of the injectors 1 and the accumulated fuel injection amount (ms) is reset to 0. Then, the injector sensitivity measuring means 4 derives a ratio between the derived mean sensitivity and an injector sensitivity estimated upon designing the control system and outputs it to the injector sensitivity correcting means 5 as an injector sensitivity deviation. The injector sensitivity correcting means 5 sets a sensitivity correction term based on the received injector sensitivity deviation. As a result, assuming that the injector sensitivity correcting means 5 and each of the injectors 1 are put together to form a virtual injector, a mean sensitivity of the virtual injectors becomes equal to the injector sensitivity estimated upon designing the control system. The fuel injection amount derived at the adder 6 is multiplied by the sensitivity correction term at the injector sensitivity correcting means 5 so as to be fed to the corresponding injector 1. The injector sensitivity correcting means 5 updates the sensitivity correction term every time the accumulated value of the fuel amounts (cc) reaches 100 cc, by multiplying a current sensitivity correction term by a newly derived injector sensitivity deviation fed from the injector sensitivity measuring means 4.

It may be arranged to measure an accumulated fuel amount (cc) in the following manner: Specifically, by filling a fuel tank to its utmost capacity every time fuel is resupplied, a resupplied fuel amount (cc) becomes equal to a fuel amount (cc) consumed up to now from the last refueling. Thus, by dividing this consumed fuel amount (cc) by an accumulated fuel injection amount (ms) up to now from the last refueling, a mean sensitivity of the injectors 1 can be derived. The refueled amount (cc) may be inputted into the controller by an operator through an input keyboard attached to the controller or may be on-line inputted into the controller from a fuel flowmeter provided at the side of a fuel supplier. In the latter case, the controller requires an interface circuit for connection to the fuel supplier.

The timing relationship between the sensitivity measurement and the sensitivity correction is as follows: In this embodiment, the sensitivity measurement results are obtained in a discrete fashion. Specifically, the sensitivity measurement results are only obtained every time the accumulated value of the fuel amounts (cc) reaches 100 cc or every time the fuel tank is refueled. On the other hand, by storing the sensitivity correction term or coefficient derived from the sensitivity measurement result, the sensitivity correction can be executed at desired timings with the newest sensitivity correction coefficient. Further, by storing the sensitivity correction coefficient in a backup memory, the sensitivity correction can be performed immediately after the power gets on. Further, if the injector sensitivity differs depending on engine operating conditions, such as engine speeds, the foregoing sensitivity measurements and the foregoing sensitivity corrections may be performed for the respective engine operating conditions, such as the respective engine speed ranges. This also applies to the sensitivity measurement and correction of the air-fuel ratio sensor, which will be described later.

As described above, even if there exists the deviation in injector sensitivity, such a sensitivity deviation can be corrected so that the lowering of the air-fuel ratio control accuracy due to the sensitivity deviation can be effectively prevented. Further, since the correction of the sensitivity deviation can also deal with the initial sensitivity deviation, the required specification of the individual injector can be relaxed to achieve reduction in cost.

As appreciated, the sensitivity measurement and correction in this embodiment may also applied to a single-cylinder engine or a multi-cylinder engine with air-fuel ratio sensors for the respective cylinders.

(Second Embodiment)

Now, a second preferred embodiment of the present invention will be described hereinbelow, wherein FIG. 1 is applied.

An operation of the injector sensitivity measuring means 4 according to this embodiment will be described with reference to FIG. 7. In this embodiment, it is assumed that the air-fuel ratio is controlled at the stoichiometric air-fuel ratio.

Figure 7:
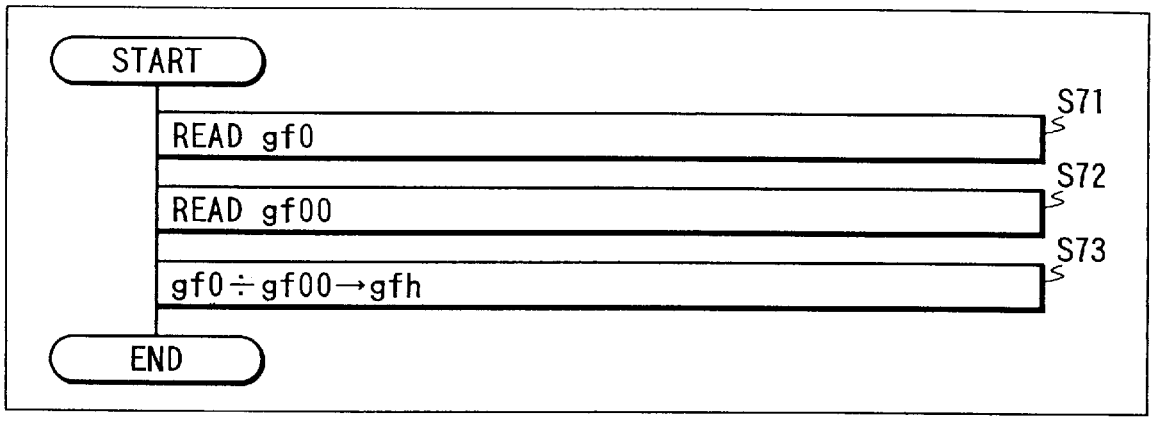
FIG. 7 is a schematic operation flowchart for explaining an operation of an air-fuel ratio control system for an internal combustion engine according to a second preferred embodiment of the present invention.

In FIG. 7, step S71 reads a current fuel injection amount gf0 derived at the adder 6. Then, step S72 reads gf00 which is a preset fuel injection amount for providing the stoichiometric air-fuel ratio in that engine operating state. If gf0 differs from gf00, that is, if the stoichiometric air-fuel ratio is achieved with gf0 which differs from gf00, this is caused by deviation in mean sensitivity of the injectors 1. Step S73 derives a deviation gfh as a ratio of gf0 relative to gf00.

The derived deviation gfh is then fed to the injector sensitivity correcting means 5 as in the foregoing first preferred embodiment.

In this embodiment, deviation in sensitivity of the air-fuel ratio sensor does not affect the injector sensitivity measurement since all the data used therefor are obtained at the stoichiometric air-fuel ratio. Thus, even if there exists the deviation in sensitivity of the air-fuel ratio sensor and even if it is not corrected, the injector sensitivity can be measured with high accuracy.

Further, in this embodiment, the fuel flowmeter, etc. required in the foregoing first preferred embodiment are not required for the injector sensitivity measurement.

As in the foregoing first preferred embodiment, the sensitivity measurement and correction in this embodiment may also applied to a single-cylinder engine or a multi-cylinder engine with air-fuel ratio sensors for the respective cylinders.

(Third Embodiment)

Now, a third preferred embodiment of the present invention will be described hereinbelow, wherein FIG. 1 is applied.

An operation of the air-fuel ratio control system according to this embodiment will be described with reference to FIG. 8. In this embodiment, the engine is of a four-cylinder type.

In the foregoing first and second preferred embodiments, the deviation in mean sensitivity of the injectors 1 (hereinafter referred to as "gfh") is derived. However, there exists dispersion in sensitivity among the injectors 1. Accordingly, in order to render a sensitivity of each of the virtual fuel injectors equal to the injector sensitivity estimated upon designing the control system, it is necessary to derive a deviation in sensitivity of each fuel injector relative to gfh and multiply gfh by the deviation in sensitivity of each fuel injector.

Figure 8:
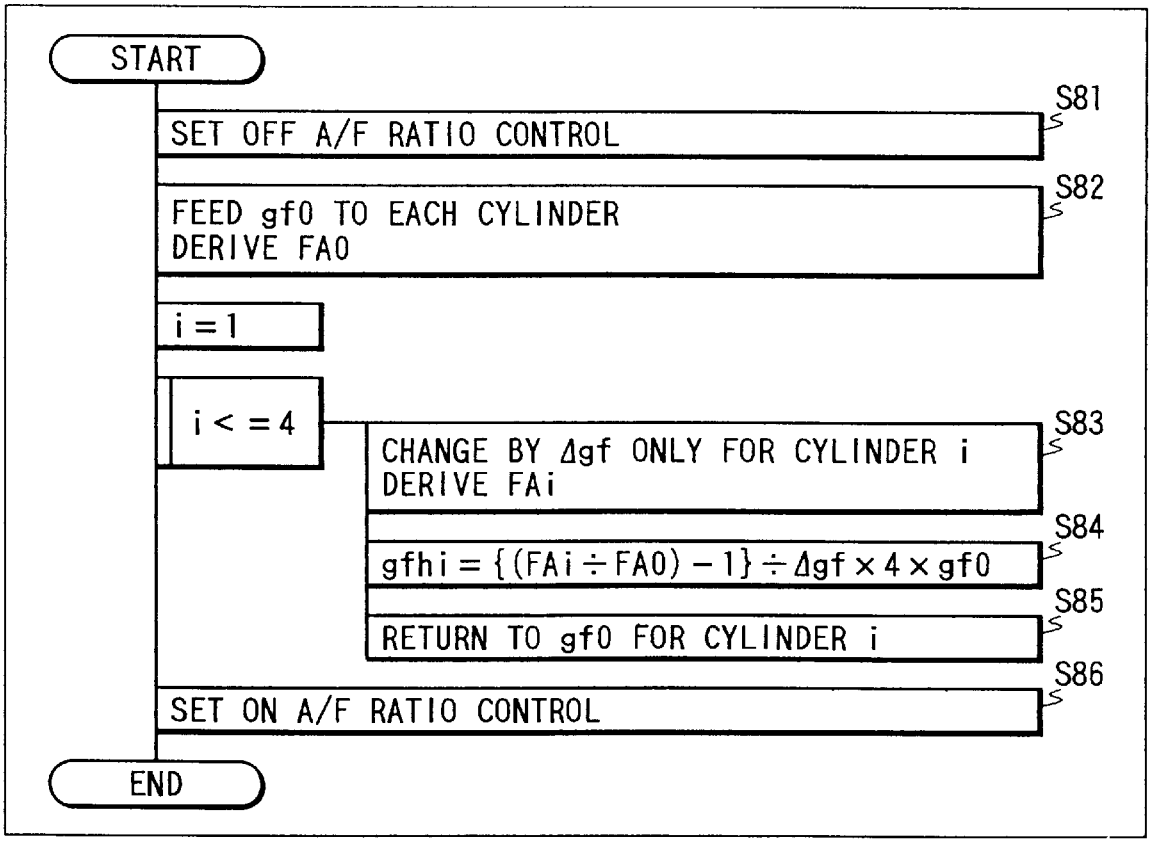
FIG. 8 is a schematic operation flowchart for explaining an operation of an air-fuel ratio control system for an internal combustion engine according to a third preferred embodiment of the present invention.

In FIG. 8, step S81 sets off the air-fuel ratio control. Then, at step S82, a signal indicative of the same fuel injection amount is fed to each of the fuel injectors 1, and a corresponding fuel-air ratio FA0 is derived. The fuel-air ratio is an inverse number of an air-fuel ratio. Subsequently, at step S83, the fuel injection amount is changed by Δgf only for the injector corresponding to the cylinder i (=1~4) and a corresponding fuel-air ratio FAi is derived. Then, step S84 derives gfhi (=((FAi/FA0)−1)/Δgf×4×gf0). Derived gfhi represents a deviation in sensitivity of the fuel injector for the cylinder i relative to gfh (deviation in mean sensitivity of the injectors). Then, at step S85, the fuel injection amount is returned to gf0 for the injector of the cylinder i. Steps S83 to S85 are repeated for the cylinders 1 to 4 in sequence so as to derive gfhi for the injectors of the cylinders 1 to 4. Subsequently, step S86 sets on the air-fuel ratio control. The injector sensitivity measuring means 4 derives the product of gfh and gfhi for each of the injectors 1 as a sensitivity correction coefficient which is used by the injector sensitivity correcting means 5 for correcting the sensitivity of the corresponding injector as in the foregoing first and second preferred embodiments. Thus, in this embodiment, the sensitivity of each of the virtual fuel injectors is set equal to the injector sensitivity estimated upon designing the control system, As appreciated, the third preferred embodiment is established on the assumption that intake air amounts introduced into the respective cylinders are equal to each other. However, since the internal combustion engine is normally designed to render the intake air amounts for the respective cylinders equal to each other, no substantial problem is raised.

The third preferred embodiment is also applicable to a multi-cylinder engine other than the four-cylinder engine.

As described above, in the third preferred embodiment, the sensitivity of the injector for each cylinder can be measured using only one air-fuel ratio sensor provided in the exhaust pipe downstream of the exhaust manifold.

Figure 2:
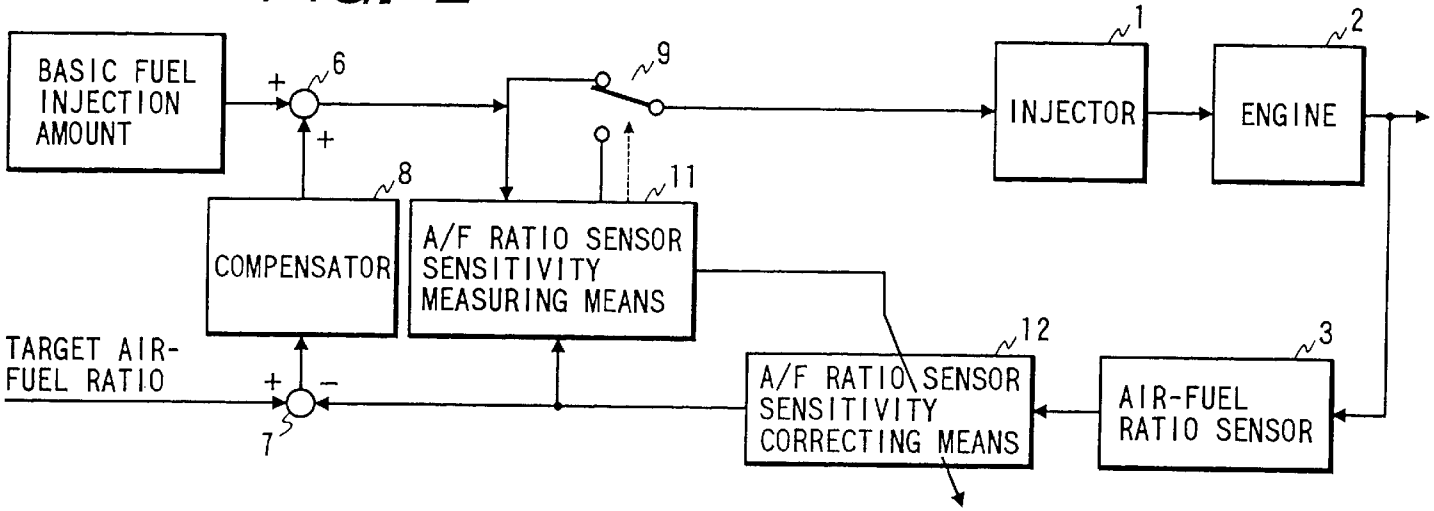
FIG. 2 is a block diagram schematically showing a general structure of an air-fuel ratio control system for an internal combustion engine, which is capable of correcting an air-fuel ratio sensor sensitivity.

FIG. 2 is a block diagram schematically showing a general structure of an air-fuel ratio control system for an internal combustion engine, which is capable of correcting an air-fuel ratio sensor sensitivity. In FIG. 2, the same or like components as those in FIG. 1 are represented by the same reference numerals. FIG. 2 differs from FIG. 1 in that air-fuel ratio sensor sensitivity measuring means 11 is provided instead of the injector sensitivity measuring means 4 and air-fuel ratio sensor sensitivity correcting means 12 is provided instead of the injector sensitivity correcting means 5 for correcting a sensitivity of the air-fuel ratio sensor 3. Thus, assuming that the air-fuel ratio sensor sensitivity correcting means 12 and the air-fuel ratio sensor 3 are put together to form a virtual air-fuel ratio sensor, a sensitivity of the virtual air-fuel ratio sensor becomes equal to an air-fuel ratio sensor sensitivity estimated upon designing the control system. However, in case of the air-fuel ratio sensor sensitivity, as opposed to the injector sensitivity, since the sensitivity is defined using the stoichiometric air-fuel ratio of 14.7 as a reference, a transfer function of the air-fuel ratio sensor sensitivity correcting means 12 is given by an equation (1):

$$out=(in-14.7)\times\alpha+14.7 \quad (1)$$

wherein α represents a sensitivity correction term, in represents an input, and out represents an output.

Like the injector sensitivity correction, if the sensitivity of the air-fuel ratio sensor 3 differs depending on engine operating conditions, the sensitivity measurements and the sensitivity corrections may be performed for the respective engine operating conditions. Particularly, there is such an air-fuel ratio sensor whose sensitivity largely changes with respect to the stoichiometric air-fuel ratio. In this case, the sensitivity measurements and corrections may be performed in both rich and lean sides relative to the stoichiometric air-fuel ratio.

(Fourth Embodiment)

Now, a fourth preferred embodiment of the present invention will be described hereinbelow, wherein FIG. 2 is applied.

In this embodiment, a high-accuracy air-fuel ratio sensor is used in addition to the air-fuel ratio sensor 3. Specifically, the high-accuracy air-fuel ratio sensor is provided in the exhaust pipe for monitoring the exhaust gas from the engine 2 to measure a corresponding air-fuel ratio. The air-fuel ratio sensor sensitivity measuring means 11 compares the air-fuel ratio measured by the high-accuracy air-fuel ratio sensor and an air-fuel ratio measured by the air-fuel ratio sensor 3 to derive a sensitivity deviation of the air-fuel ratio sensor 3 as the injector sensitivity measuring means 4 in the first or second preferred embodiment. The derived sensitivity deviation is fed to the air-fuel ratio sensor sensitivity correcting means 12. The air-fuel ratio sensor sensitivity correcting means 12 sets a correction term or coefficient based on the sensitivity deviation of the air-fuel ratio sensor 3 so as to correct the sensitivity of the air-fuel ratio sensor 3 as the injector sensitivity correcting means 5 in the first or second preferred embodiment.

The high-accuracy air-fuel ratio sensor is used only for the sensitivity measurement performed in a factory or the like so that it may be detached during the normal driving of the vehicle.

In a modification, the standard gas whose air-fuel ratio is precisely known may be used. Specifically, upon the sensitivity measurement, the engine is stopped and the standard gas is fed into the exhaust pipe. Then, by deriving a deviation of an output of the air-fuel ratio sensor 3 relative to the air-fuel ratio of the standard gas, a sensitivity deviation of the air-fuel ratio sensor 3 can be derived.

In general, the sensitivity of the air-fuel ratio sensor differs at the rich and lean sides. Thus, by performing the sensitivity measurements at both sides, the virtual air-fuel ratio sensor is set to have a constant sensitivity regardless of the rich or lean side.

As described above, even if there exists the deviation in air-fuel ratio sensor sensitivity, such a sensitivity deviation can be corrected so that the lowering of the air-fuel ratio control accuracy due to the sensitivity deviation can be effectively prevented. Further, since the correction of the sensitivity deviation can also deal with the initial sensitivity deviation, the required specification of the individual air-fuel ratio sensor can be relaxed to achieve reduction in cost.

As appreciated, it is effective to perform the correction of the sensitivity of the air-fuel ratio sensor in the fourth preferred embodiment or in the modification thereof, along with the injector sensitivity correction.

(Fifth Embodiment)

Now, a fifth preferred embodiment of the present invention will be described hereinbelow, wherein FIG. 2 is applied.

An operation of the air-fuel ratio sensor sensitivity measuring means 11 according to this embodiment will be described with reference to FIG. 3. In this embodiment, it is assumed that the air-fuel ratio is controlled at the stoichiometric air-fuel ratio.

Figure 3:
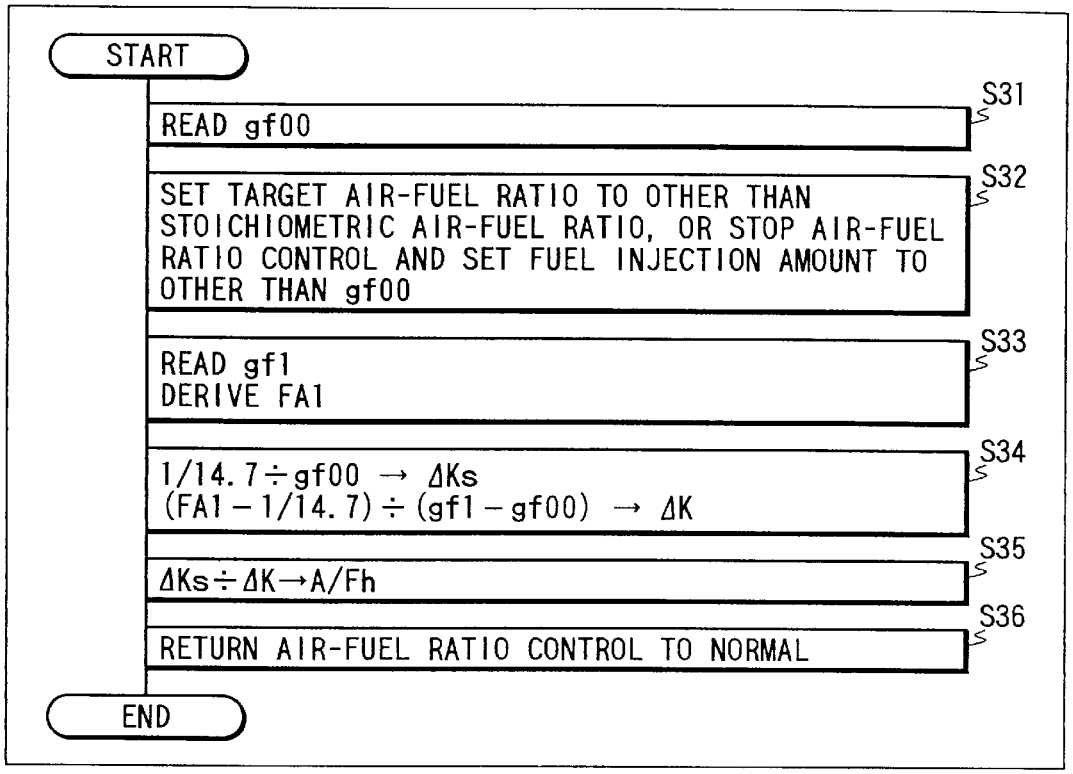
FIG. 3 is a schematic operation flowchart for explaining an operation of an air-fuel ratio control system for an internal combustion engine according to a fifth preferred embodiment of the present invention.

In FIG. 3, step S31 reads gf00 which is a preset fuel injection amount for providing the stoichiometric air-fuel ratio in that engine operating state. Then, at step S32, a target air-fuel ratio is set to other than the stoichiometric air-fuel ratio, or the air-fuel ratio control is stopped and a fuel injection amount other than gf00 is set. Subsequently, step S33 reads a current fuel injection amount gf1 and derives a corresponding fuel-air ratio FA1. Then, at step S34, a reference sensitivity ΔKs of the air-fuel ratio sensor is derived by (1/14.7)/gf00 and an actual sensitivity ΔK of the air-fuel ratio sensor is derived by (FA1−1/14.7)/(gf1−gf00). The reference sensitivity ΔKs is an ideal sensitivity of the air-fuel ratio sensor considered upon designing the control system, while the actual sensitivity ΔK is a measured sensitivity of the air-fuel ratio sensor 3. Specifically, the fuel injection amount and the fuel-air ratio are proportional to each other provided that the air amount is the same. Thus, the relationship therebeween reveals a straight line on the coordinate plane, and the sensitivity of the air-fuel ratio sensor is represented by a gradient of this straight line. Accordingly, at step S34, ΔKs is defined by a straight line which passes through the origin and a coordinate point (gf00, 1/14.7), while ΔK is defined by a straight line which passes through a coordinate point (gf00, 1/14.7) and a coordinate point (gf1, FA1).

Subsequently, at step S35, a sensitivity deviation A/Fh of the air-fuel ratio sensor is derived by ΔKs/ΔK and fed to the air-fuel ratio sensor sensitivity correcting means 12. The air-fuel ratio sensor sensitivity correcting means 12 sets a correction term or coefficient based on the sensitivity deviation A/Fh so as to correct the sensitivity of the air-fuel ratio sensor 3 as in the foregoing fourth preferred embodiment. Then, at step S36, the air-fuel ratio control is returned to normal.

Since gf00 is determined depending on the intake air amount. Thus, it is necessary to store gf00 in terms of the corresponding intake air amounts in a look-up table. If the engine operating range is extensive, it is possible that the look-up table is increased in data volume or the accuracy of gf00 is lowered. Thus, this embodiment is particularly effective when the engine operating range is narrow.

Depending on the characteristic of the air-fuel ratio sensor or the operation state of the engine, the output of the air-fuel ratio fluctuates even if a constant fuel amount is injected. In such a case, the time averaging may be performed for achieving the required accuracy. On the other hand, since it is necessary that the intake air amount is constant during the averaging, an error may be caused when the engine operating state changes abruptly or the averaging is performed for a long time. In view of this, it is necessary to minimize the averaging time to a possible extent.

Further, this embodiment is established on the assumption that there exist no sensitivity deviations of the injectors when comparing the injector sensitivities upon designing and upon measurement. Since the measurement error is increased when the injector sensitivity deviation is large, this embodiment is effective for the engine with the injector sensitivity deviation being small or the engine where the injector sensitivity deviation is corrected.

The foregoing time averaging technique is effective not only for this embodiment but also for the other embodiments.

In this embodiment, since the high-accuracy air-fuel ratio sensor or the standard gas is not required as opposed to the foregoing fourth preferred embodiment, the measurement of the air-fuel ratio sensor sensitivity can be achieved easily and less expensively.

(Sixth Embodiment)

Now, a sixth preferred embodiment of the present invention will be described hereinbelow, wherein FIG. 2 is applied.

An operation of the air-fuel ratio sensor sensitivity measuring means 11 according to this embodiment will be described with reference to FIG. 4.

In the foregoing fifth preferred embodiment (FIG. 3), the fuel injection amounts gf00 are preset for providing the stoichiometric air-fuel ratio in the corresponding engine operating conditions. On the other hand, in this embodiment, a fuel injection amount which provides the stoichiometric air-fuel ratio is actually derived by performing the stoichiometric air-fuel ratio control. Thus, it is not necessary to store gf00 in terms of the corresponding intake air amounts in the look-up table as opposed to the foregoing fifth preferred embodiment.

Figure 4:
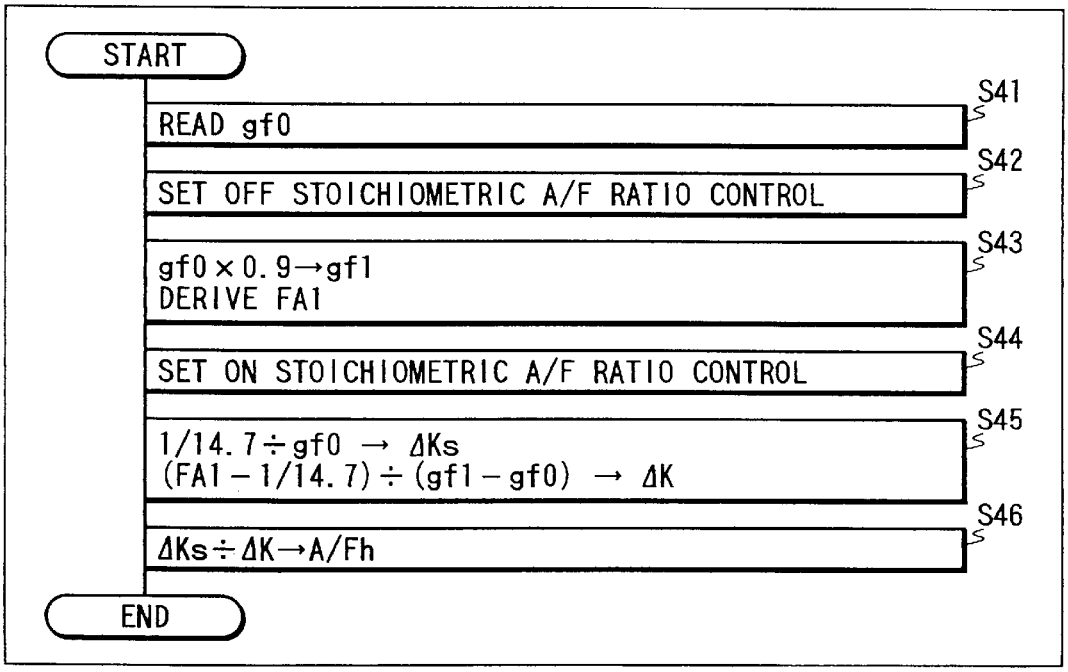
FIG. 4 is a schematic operation flowchart for explaining an operation of an air-fuel ratio control system for an internal combustion engine according to a sixth preferred embodiment of the present invention.

Referring now to FIG. 4, step S41 reads a current fuel injection amount gf0, and then step S42 sets off the stoichiometric air-fuel ratio control. Subsequently, at step S43, a fuel injection amount gf1 which is reduced by 10% relative to gf0 is set and a corresponding fuel-air ratio FA1 is derived. Then, at step S44, the stoichiometric air-fuel ratio control is set on. Subsequently, at step S45, a reference sensitivity ΔKs of the air-fuel ratio sensor is derived by (1/14.7)/gf0 and an actual sensitivity ΔK of the air-fuel ratio sensor is derived by (FA1−1/14.7)/(gf1−gf0), wherein gf0 represents a fuel injection amount providing the stoichiometric air-fuel ratio. Then, at step S46, a sensitivity deviation A/Fh of the air-fuel ratio sensor is derived by ΔKs/ΔK and fed to the air-fuel ratio sensor sensitivity correcting means 12 as in the foregoing fifth preferred embodiment.

In this embodiment, since the two coordinate points on the straight line defining the actual sensitivity ΔK are obtained upon sensitivity measurement, the sensitivity measurement is not liable to be affected by the injector sensitivity deviation. As appreciated from the equations shown in FIG. 4, the sensitivity deviation of the air-fuel ratio sensor is finally derived from the ratio between the fuel injection amounts. Thus, the sensitivity deviation of the air-fuel ratio sensor can be derived even when the injector sensitivity deviation is unknown. As a result, even if there exists the injector sensitivity deviation, the high-accuracy sensitivity measurement of the air-fuel ratio sensor can be achieved.

As described above, in this embodiment, even if the engine operating range is extensive or even if the injector sensitivity deviation is large and still not corrected, the air-fuel ratio sensor sensitivity deviation can be derived with high accuracy.

(Seventh Embodiment)

Now, a seventh preferred embodiment of the present invention will be described hereinbelow, wherein FIG. 2 is applied.

An operation of the air-fuel ratio sensor sensitivity measuring means 11 according to this embodiment will be described with reference to FIGS. 5 and 6. In this embodiment, two coordinate points which determine an actual sensitivity of the air-fuel ratio sensor, are obtained without executing the stoichiometric air-fuel ratio control.

Figure 5:
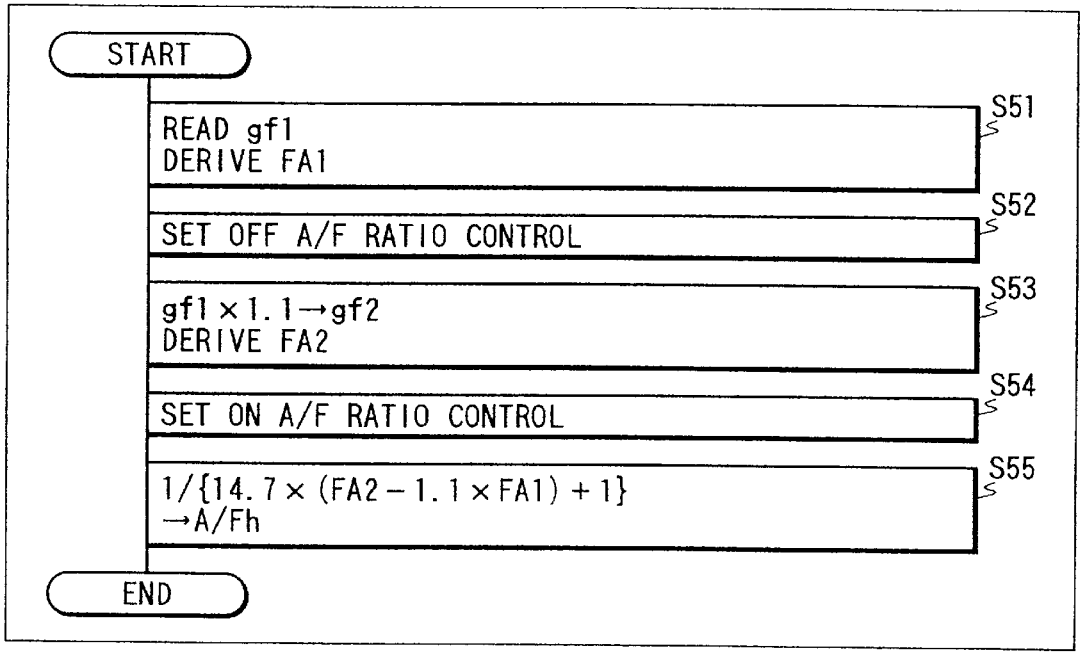
FIG. 5 is a schematic operation flowchart for explaining an operation of an air-fuel ratio control system for an internal combustion engine according to a seventh preferred embodiment of the present invention.
Figure 6:
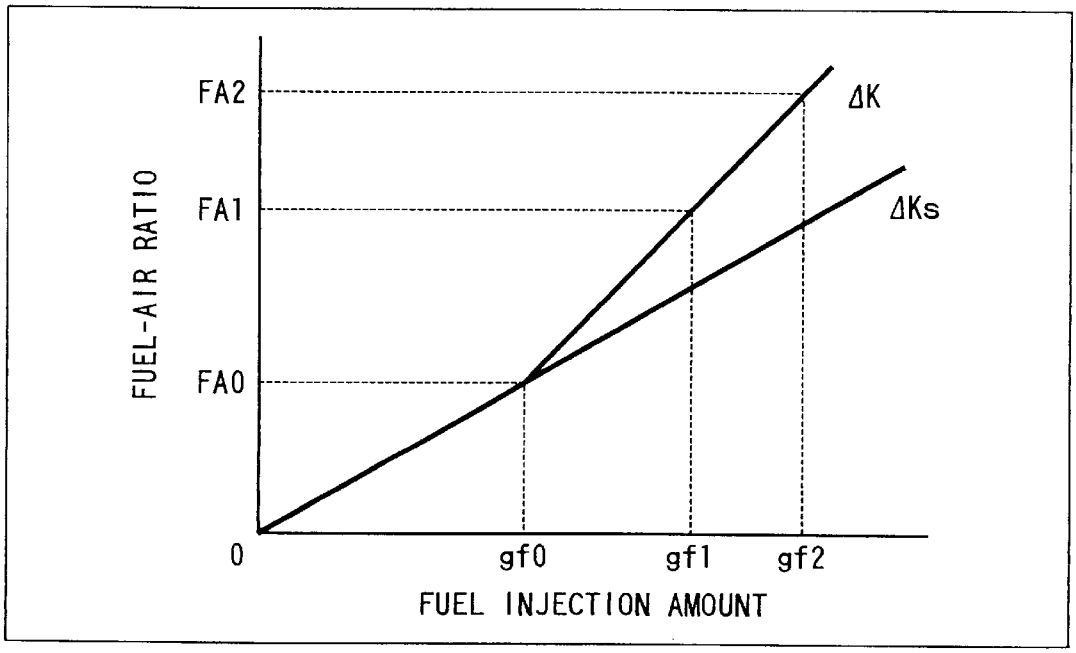
FIG. 6 is a graph for explaining derivation of an equation used in the seventh preferred embodiment.

In FIG. 5, step S51 reads a current fuel injection amount gf1 and further derives a corresponding fuel-air ratio FA1. Then, step S52 sets off the air-fuel ratio control. Subsequently, at step S53, a fuel injection amount gf2 which is increased by 10% relative to gf1 is set and a corresponding fuel-air ratio FA2 is derived. Then, at step S54, the air-fuel ratio control is set on.

Subsequently, step S55 is executed. An equation of A/Fh=1/(147×(FA2−1.1×FA1)+1) shown at step S55 will be explained with reference to FIG. 6. In FIG. 6, the axis of abscissas defines fuel injection amounts, while the axis of ordinates defines fuel-air ratios. As in the foregoing fifth and sixth preferred embodiments, ΔKs represents a reference sensitivity of the air-fuel ratio sensor, while ΔK represents an actual sensitivity of the air-fuel ratio sensor. FA0 , FA1 and FA2 represent fuel-air ratios, respectively, when the fuel injection amounts are set to gf0, gf1 and gf2, respectively. Since FA0 is a stoichiometric fuel-air ratio, FA0 is 1/14.7 while gf0 is unknown.

An equation 2 is established as follows:

$$\Delta Ks = \frac{FA0}{gf0} \tag{2}$$

$$\Delta K = \frac{FA2 - FA1}{gf2 - gf1} = \frac{FA1 - FA0}{gf1 - gf0}$$

A sensitivity deviation of the air-fuel ratio sensor is given by an equation (3):

$$A/Fh = \frac{\Delta Ks}{\Delta K} \tag{3}$$

Giving an equation of a straight line defining ΔK and deriving gf0, an equation (4) is given as follows:

$$\begin{aligned} A/Fh &= \frac{FA1 - FA0}{FA2 - FA1} \times (gf2 - gf1) \\ &= \frac{gf1 \times (FA2 - FA0) - gf2 \times (FA1 - FA0)}{FA2 - FA1} \end{aligned} \tag{4}$$

Putting the equations (2) and (4) into the equation (3), an equation (5) is given as follows:

$$\begin{aligned} A/Fh &= \frac{FA0}{gf0} \times \frac{gf2 - gf1}{FA2 - FA1} \\ &= \frac{FA0 \times (gf2 - gf1)}{gf1 \times (FA2 - FA0) - gf2 \times (FA1 - FA0)} \end{aligned} \tag{5}$$

An equation (6) is given as follows:

$$gf2 = \alpha \times gf1 \tag{6}$$

Putting the equation (6) into the equation (5), an equation (7) is given as follows:

$$\begin{aligned} A/Fh &= \frac{FA0 \times (\alpha - 1)}{FA2 - FA0 - \alpha \times (FA1 - FA0)} \\ &= \frac{FA0 \times (\alpha - 1)}{FA2 - \alpha \times FA1 + (\alpha - 1) \times FA0} \end{aligned} \tag{7}$$

Given that α=1.1 and FA0=1/14.7, an equation (8) is obtained from the equation (7):

$$\begin{aligned} A/Fh &= \frac{\frac{1}{14.7} \times (1.1 - 1)}{FA2 - 1.1 \times FA1 + \frac{1.1 - 1}{14.7}} \\ &= \frac{0.1}{14.7 \times (FA2 - 1.1 \times FA1) + 0.1} \\ &= \frac{1}{147 \times (FA2 - 1.1 \times FA1) + 1} \end{aligned} \tag{8}$$

The derived sensitivity deviation A/Fh of the air fuel ratio sensor is fed to the air-fuel ratio sensor sensitivity correcting means 12 as in the foregoing fifth or sixth preferred embodiment.

In the sixth preferred embodiment, the stoichiometric air-fuel ratio control is required for deriving A/Fh, while it is not required in this embodiment. Thus, the sensitivity of the air-fuel ratio sensor can be measured with high accuracy even in the state where the air-fuel ratio is controlled at other than the stoichiometric air-fuel ratio, for example, in the lean burn control.

(Eighth Embodiment)

Now, an eighth preferred embodiment of the present invention will be described hereinbelow. This embodiment is common to FIGS. 1 and 2.

As described in the foregoing fifth preferred embodiment, when the sensor noise is large and thus the long averaging time is required, a problem may be raised due to an error caused by the change of the engine operating state. If the engine operating state does not substantially change, the prolongation of the averaging time does not raise a substantial problem. However, if the averaging is performed while the engine operating state changes, the sensitivity measurement error is caused. Thus, for suppressing the sensitivity measurement error, the measurement of the injector sensitivity or the air-fuel ratio sensor sensitivity may be performed while detecting the engine operating state in which the change is small.

An operation of this embodiment will be described with reference to FIG. 9.

Figure 9:
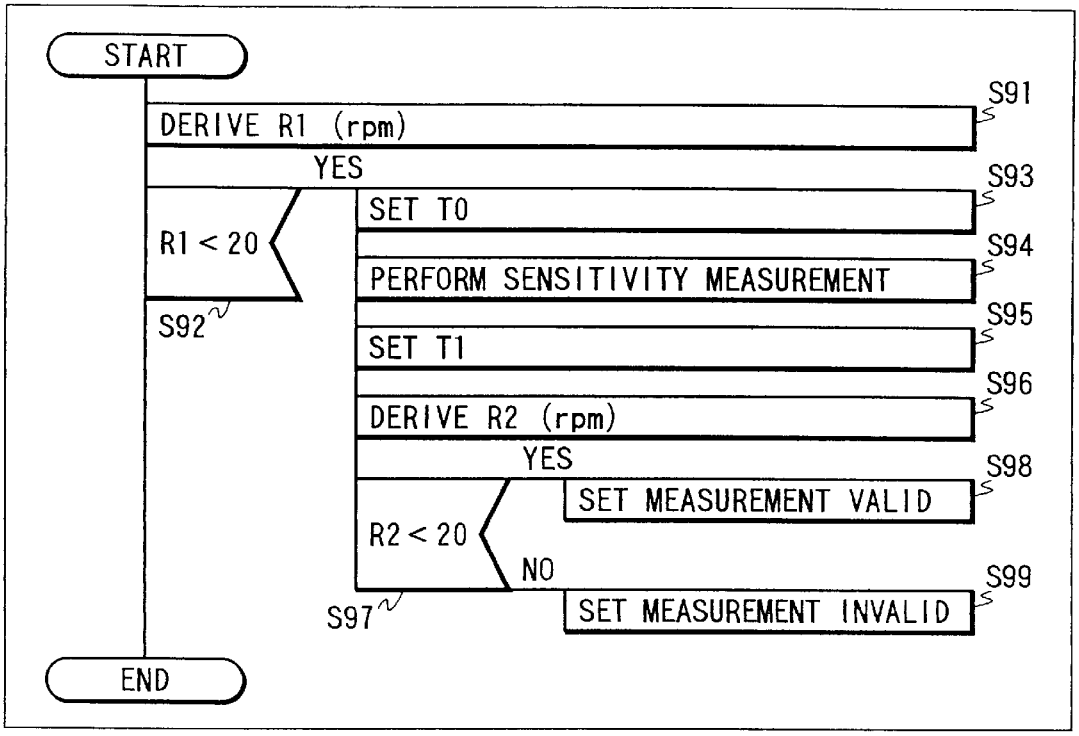
FIG. 9 is a schematic operation flowchart for explaining an operation of an air-fuel ratio control system for an internal combustion engine according to an eighth preferred embodiment of the present invention.

In FIG. 9, step S91 derives an engine speed variation R1 [rpm] over the past ten seconds. Then, at step S92, it is checked whether R1<20. If positive, the routine proceeds to step S93, while, if negative, this routine is terminated. Step S91 monitors the engine speed since the engine speed represents the engine operating state most directly. The time period of ten seconds is selected because, if R1<20 continues for ten seconds, the probability is high that R1<20 will continue thereafter. If the higher probability is desired, the time period may be prolonged. On the other hand, the sensitivity measurement is required more frequently, the time period may be set to 0.

At step S93, a current time T0 is set. Then, at step S94, the measurement of the injector sensitivity and/or the air-fuel ratio sensor sensitivity is performed. Subsequently, step S95 sets a current time T1. Then, step S96 derives an engine speed variation R2 [rpm] from T0 to T1. If R2<20 at step S97, the routine proceeds to step S98 where the measured sensitivity is set valid, while, if otherwise, the routine proceeds to step S99 where the measured sensitivity is set invalid (which is the same as no sensitivity measurement having been performed).

It may be arranged that step S94 also monitors the engine speed variation simultaneously with performing the sensitivity measurement and, if the monitored engine speed variation becomes no less than 20 [rpm], the routine is terminated.

With foregoing arrangement, even if the noise of the air-fuel ratio sensor is large or the engine operating state changes largely, the measurement of the injector sensitivity and/or the air-fuel ratio sensor sensitivity can be performed with high accuracy.

(Ninth Embodiment)

Now, a ninth preferred embodiment of the present invention will be described hereinbelow.

In this embodiment, the throttle opening degree is also monitored in addition to the engine speed. As appreciated, even if the engine speed is held constant, the load may possibly change so that the throttle opening degree and thus the intake air amount may also change. Accordingly, if only the engine speed is monitored, it is possible that the change of the engine operating state during the sensitivity measurement can not be detected so that the measured sensitivity may include an error.

An operation of this embodiment will be described with reference to FIG. 10.

Figure 10:
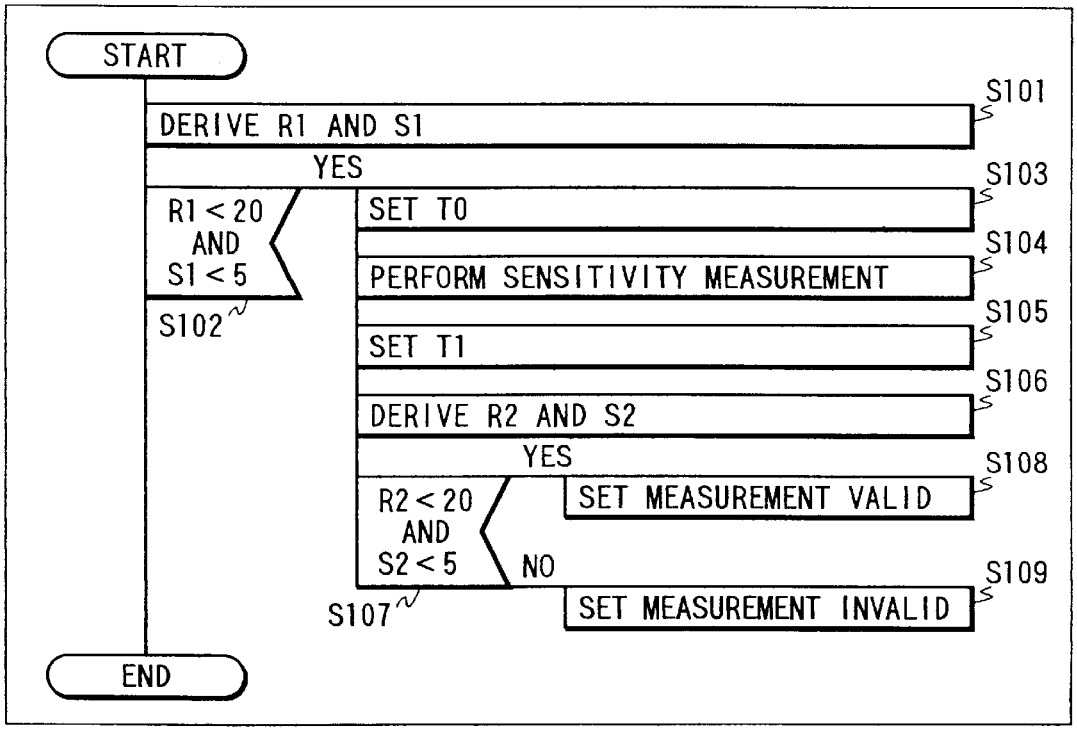
FIG. 10 a schematic operation flowchart for explaining an operation of an air-fuel ratio control system for an internal combustion engine according to a ninth preferred embodiment of the present invention.

In FIG. 10, step S101 derives an engine speed variation R1 [rpm] over the past ten seconds and further derives a throttle opening degree variation S1 [deg] over the past ten seconds. Then, at step S102, it is checked whether R1<20 and S1<5 simultaneously. If positive, the routine proceeds to step S103, while, if negative, this routine is terminated. Since steps S103 to S105 are the same as steps S93 to S95 in FIG. 9, explanation thereof is omitted.

From step S105, the routine proceeds to step S106 which derives an engine speed variation R2 [rpm] from T0 to T1 and further derives a throttle opening degree variation S2 [deg] from T0 to T1. If R2<20 and S2<5 simultaneously at step S107, the routine proceeds to step S108 where the measured sensitivity is set valid, while, if otherwise, the routine proceeds to step S109 where the measured sensitivity is set invalid (which is the same as no sensitivity measurement having been performed).

(Tenth Embodiment)

Now, a tenth preferred embodiment of the present invention will be described hereinbelow.

In this embodiment, a condition of the engine speed being less than a given value is added to the foregoing eighth preferred embodiment (FIG. 9). The increase of the engine speed may cause fluctuation in output of the air-fuel ratio sensor. Thus, for achieving the required accuracy, it is necessary to prolong the averaging time. However, when the averaging time is prolonged, the aforementioned sensitivity measurement error may be resulted. If the averaging time is set equal between the high speeds and the low speeds of the engine, the insufficient accuracy is resulted at the engine high speeds, while the unnecessarily long time is consumed at the engine low speeds.

In view of this, in this embodiment, the averaging time is set to a value which can ensure given accuracy at the engine low speeds, while the sensitivity measurement is not performed at the engine high speeds. With this arrangement, since the sensitivity measurement is not performed at the engine high speeds, the influence of the sensitivity measurement error to be generated at the engine high speeds can be prevented. It may be arranged that the averaging time is set to change depending on the engine speeds.

An operation of this embodiment will be described with reference to FIG. 11.

Figure 11:
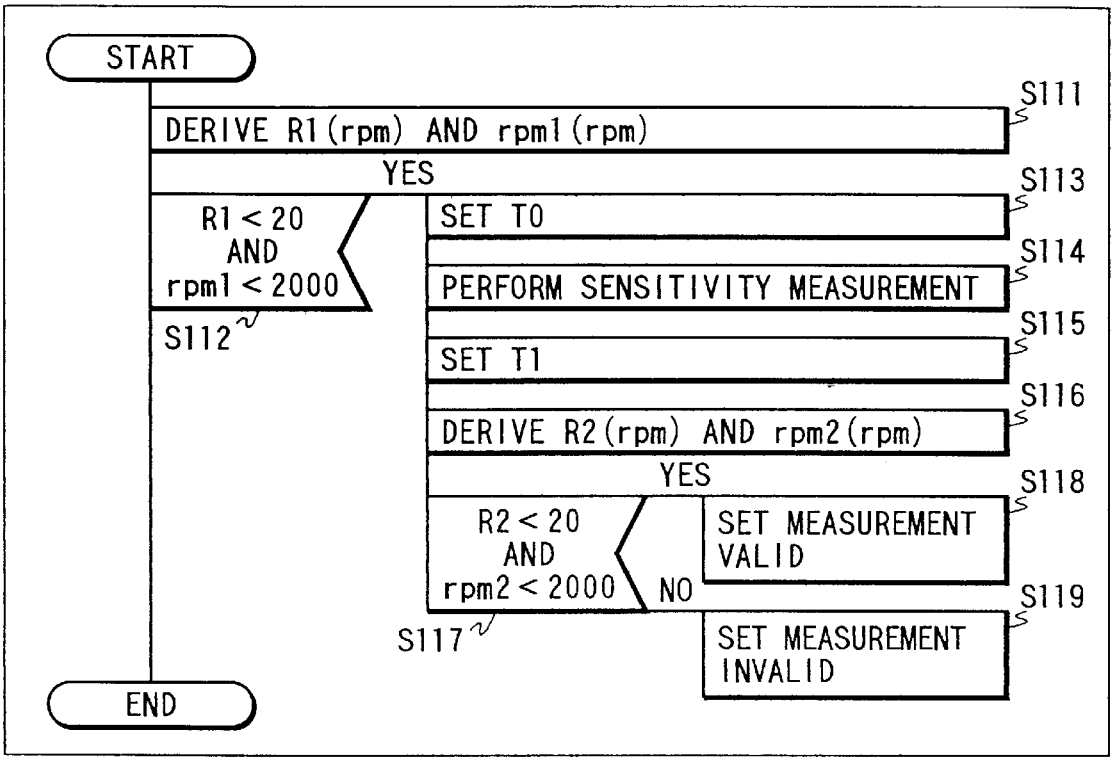
FIG. 11 is a schematic operation flowchart for explaining an operation of an air-fuel ratio control system for an internal combustion engine according to a tenth preferred embodiment of the present invention.

In FIG. 11, step S111 derives an engine speed variation R1 [rpm] over the past ten seconds and further derives engine speeds rpm1 [rpm] over the past ten seconds. Then, at step S112, it is checked whether R1<20 and rpm1<2000 simultaneously. If positive, the routine proceeds to step S113, while, if negative, this routine is terminated. Since steps S113 to S115 are the same as steps S93 to S95 in FIG. 9, explanation thereof is omitted.

From step S115, the routine proceeds to step S116 which derives an engine speed variation R2 [rpm] from T0 to T1 and further derives engine speeds rpm2 [rpm] from T0 to T1. If R2<20 and rpm2<2000 simultaneously at step S117, the routine proceeds to step S118 where the measured sensitivity is set valid, while, if otherwise, the routine proceeds to step S119 where the measured sensitivity is set invalid (which is the same as no sensitivity measurement having been performed).

(Eleventh Embodiment)

Now, an eleventh preferred embodiment of the present invention will be described hereinbelow.

In this embodiment, the measurement of the injector sensitivity and/or the air-fuel ratio sensor sensitivity is performed during the engine idling. When the vehicle is running, there occur the engine speed fluctuation, the load fluctuation and the throttle opening degree fluctuation. On the other hand, those fluctuations are very small in the idling state of the engine. Thus, the sensitivity measurement can be achieved with high accuracy. Since the engine operation fluctuations are very small, the driving range of the idling state is very narrow relative to all the driving ranges of the engine so that the volume of values preset depending on the engine operating conditions can be reduced. This is also desirable for the sensitivity measurement. Further, the time ratio of the idling state relative to all the driving states is normally high, which is also convenient for the sensitivity measurement. Moreover, in general, the automotive engines have been provided with an idling state detecting function. Thus, without adding any particular detecting function, the system can be operated.

An operation of this embodiment will be described with reference to FIG. 12.

Figure 12:
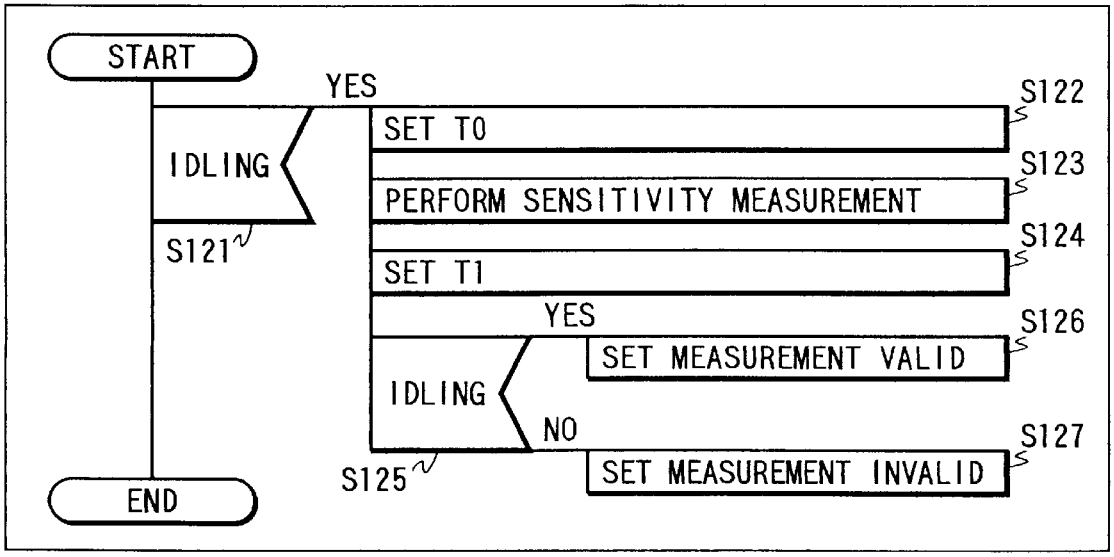
FIG. 12 is a schematic operation flowchart for explaining an operation of an air-fuel ratio control system for an internal combustion engine according to an eleventh preferred embodiment of the present invention.

In FIG. 12, step S121 determines whether the engine is in the idling state. If positive, the routine proceeds to step S122, while, if negative, the routine is terminated. Since steps S122 to S124 are the same as steps S93 to S95 in FIG. 9, explanation thereof is omitted.

From step S124, the routine proceeds to step S125 which determines whether the engine was in the idling state from T0 to T1. If positive, the routine proceeds to step S126 where the measured sensitivity is set valid, while, if negative, the routine proceeds to step S127 where the measured sensitivity is set invalid (which is the same as no sensitivity measurement having been performed).

(Twelfth Embodiment)

Now, a twelfth preferred embodiment of the present invention will be described hereinbelow.

Figure 13:
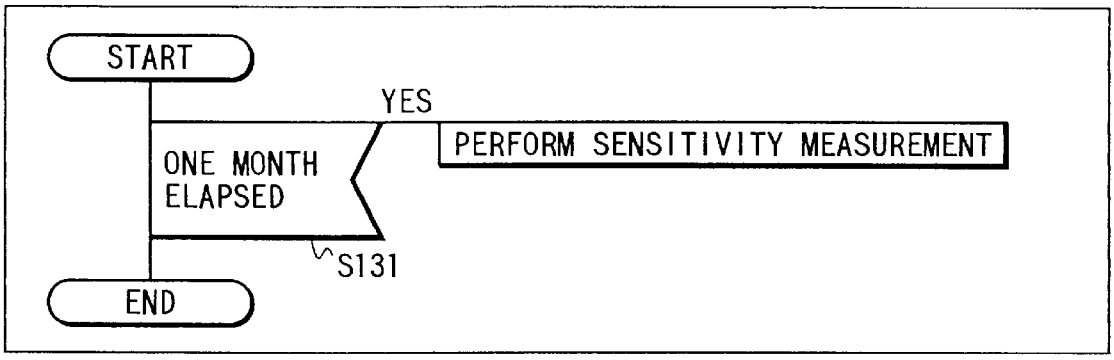
FIG. 13 is a schematic operation flowchart for explaining an operation of an air-fuel ratio control system for an internal combustion engine according to a twelfth preferred embodiment of the present invention.

FIG. 13 shows an operation flowchart according to this embodiment. This flowchart may be added to each of the flowcharts shown in FIGS. 9 to 12. For example, it is assumed that FIG. 13 is added to FIG. 12. In this case, step S131 in FIG. 13 is first executed to determine whether one month has elapsed since the last sensitivity measurement. If negative, the flowchart of FIG. 12 is not executed. On the other hand, if positive, the flowchart of FIG. 12 is executed. If step S126 is executed, that is, the measured sensitivity is set valid, the sensitivity measurement is not performed until another one month has elapsed. Determination of a lapse of one month can be easily achieved using a timer or the like in the controller.

As appreciated, this embodiment is suitable for measuring and correcting a deviation of the injector sensitivity or the air-fuel ratio sensor sensitivity caused by relatively slow aged deterioration.

(Thirteenth Embodiment)

Now, a thirteenth preferred embodiment of the present invention will be described hereinbelow.

In this embodiment, instruction for the sensitivity measurement is given by an operator. This is particularly effective when performing the sensitivity measurement in the factory for the air-fuel ratio control system which is designed suitable for the sensitivity measurement during the actual driving of the vehicle. For example, in the foregoing twelfth preferred embodiment, one month is required between two sensitivity measurements. This deteriorates the working efficiency of the sensitivity measurement in the factory. Thus, in this embodiment, such a determining condition is released by the external command.

Figure 14:
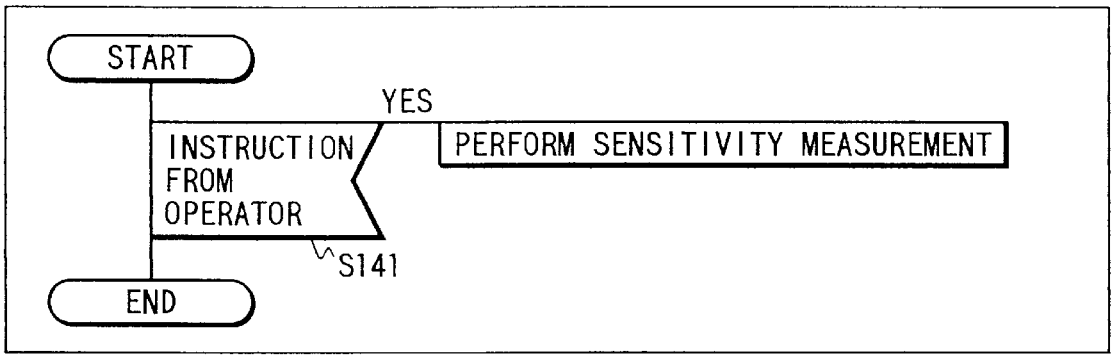
FIG. 14 is a schematic operation flowchart for explaining an operation of an air-fuel ratio control system for an internal combustion engine according to a thirteenth preferred embodiment of the present invention.

FIG. 14 shows an operation flowchart according to this embodiment. Input means may be provided for feeding commands to the controller. When answer at step S141 becomes positive, the controller may forcibly establish the sensitivity measurement condition in the flowchart of, for example, in FIG. 12. As another method for giving the command to the controller, an input port of the microcomputer in the controller may be connected to an external connector and, when performing the sensitivity measurement, the operator may connect a terminal thereof to ground so that the microcomputer can recognize the operator's action. In the future, if the controller of the engine or the navigation device can send data to and receive data from an advanced on-vehicle terminal via a LAN or the like, it may be possible to give commands using a HMI (human machine interface) of the on-vehicle terminal.

(Fourteenth Embodiment)

Now, a fourteenth preferred embodiment of the present invention will be described hereinbelow.

Figure 15:
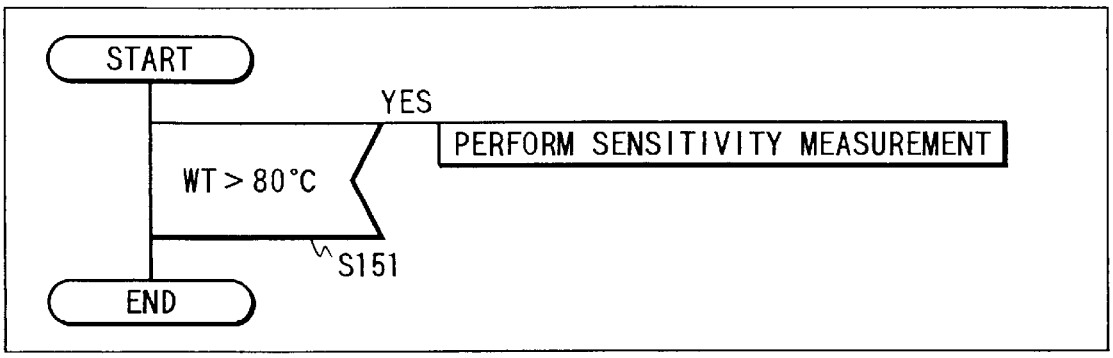
FIG. 15 a schematic operation flowchart for explaining an operation of an air-fuel ratio control system for an internal combustion engine according to a fourteenth preferred embodiment of the present invention.

FIG. 15 shows an operation flowchart according to this embodiment. In this embodiment, the sensitivity measurement can be performed only after the engine has been warmed up, that is, only when the engine cooling water temperature is higher than 80° C. as determined at step S151 in FIG. 15. As is known, the purification rate of the three way catalytic converter is maximum at the stoichiometric air-fuel ratio. On the other hand, in some of the foregoing preferred embodiments, the air-fuel ratio is, even temporarily, positively deviated from the stoichiometric air-fuel ratio for performing the sensitivity measurement. Thus, even temporarily, the purification rate of the three way catalytic converter is reduced, which, however, can be solved by minimizing the sensitivity measuring time relative to all the driving time. Further, by performing the correct sensitivity measurement, the control characteristic other than upon sensitivity measurement can be improved to achieve the exhaust gas purification on the total basis.

In general, the exhaust gas purification rate of the three way catalytic converter is increased in the fully warmed-up state as compared with in the cold state. Thus, it is desirable to perform the sensitivity measurement after completion of the engine warm-up unless the engine is provided with an electric heater or the like to activate the three way catalytic converter even when the engine is still cold.

(Fifteenth Embodiment)

Now, a fifteenth preferred embodiment of the present invention will be described hereinbelow.

In this embodiment, the sensitivity measurements are performed at given engine speeds, respectively. The engine speed is automatically controlled by using an actuator of a throttle valve to change throttle opening degrees. For such an automatic control, it is necessary that the controller which executes the sensitive measurement and correction can control the throttle opening degree directly or indirectly via communication means.

Figure 16:
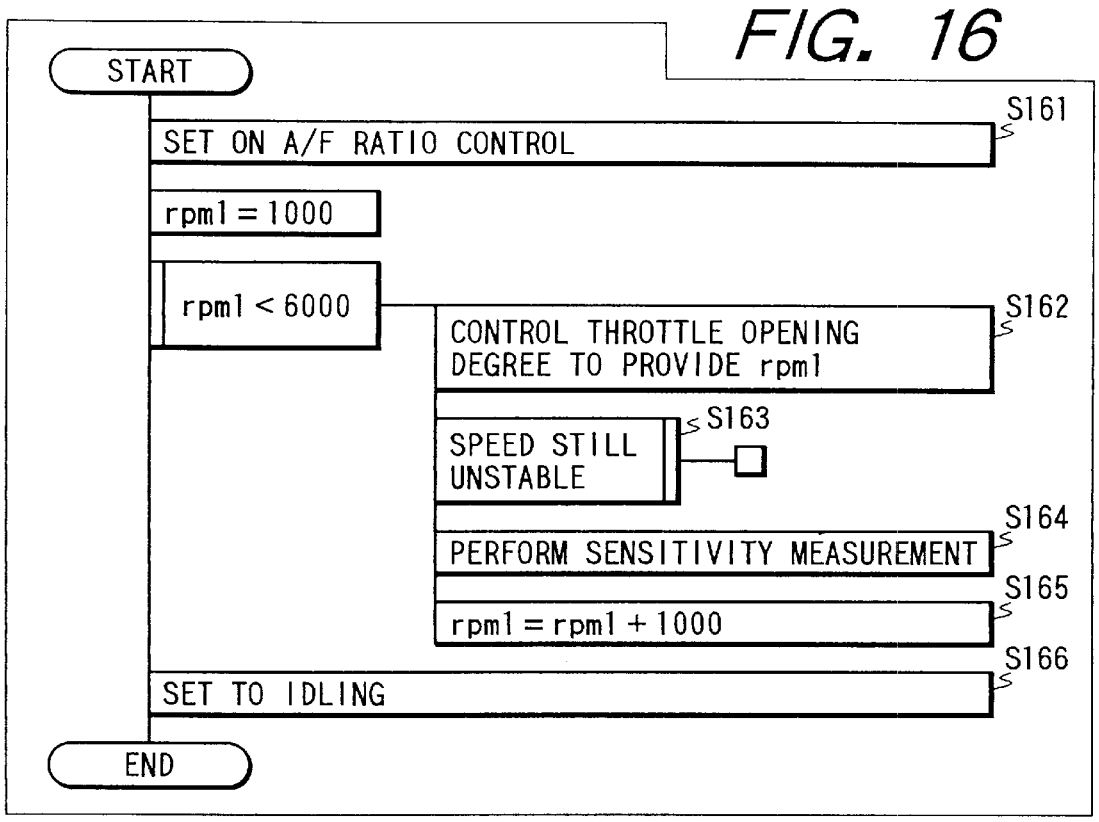
FIG. 16 is a schematic operation flowchart for explaining an operation of an air-fuel ratio control system for an internal combustion engine according to a fifteenth preferred embodiment of the present invention.

FIG. 16 shows an operation flowchart according to this embodiment.

In FIG. 16, step S161 sets on the air-fuel ratio control. In this flowchart, the sensitivity measurement is performed per 1000 rpm in the range from 1000 rpm to 5000 rpm. At step S162, the throttle opening degree is controlled to first provide 1000 rpm. Then, through step S163, if the engine speed is stabilized at 1000 rpm, step S164 performs the sensitivity measurement so as to derive a sensitivity correction term or coefficient around 1000 rpm. Then, the engine speed is set to 2000 rpm through step S165, and a sensitivity correction term is derived around 2000 rpm in a similar manner. Thereafter, sensitivity correction terms up to 5000 rpm are derived similarly. In the actual sensitivity correction, the sensitivity correction term is selected depending on the engine speed at that time for correction of the sensitivity. Since this can be designed easily, explanation thereof is omitted.

Through step S166, the engine is set to the idling state.

As described above, when the sensitivity of the injector or the air-fuel ratio sensor changes depending on the engine operating state, the sensitivity measurements at the respective engine speeds can be achieved automatically using the actuator of the throttle valve. Thus, since the sensitivity measurements at the respective engine operating states can be realized with a small number of sensitivity measurement steps, the accuracy of the air-fuel ratio control can be improved.

(Sixteenth Embodiment)

Now, a sixteenth preferred embodiment of the present invention will be described hereinbelow.

Some of the engines, such as gasoline engines, are provided with a canister purge function. It is possible that the canister purge function causes substantial errors in the sensitivity measurement. This embodiment aims to solve this problem.

An operation of this embodiment will be described with reference to FIG. 17.

Figure 17:
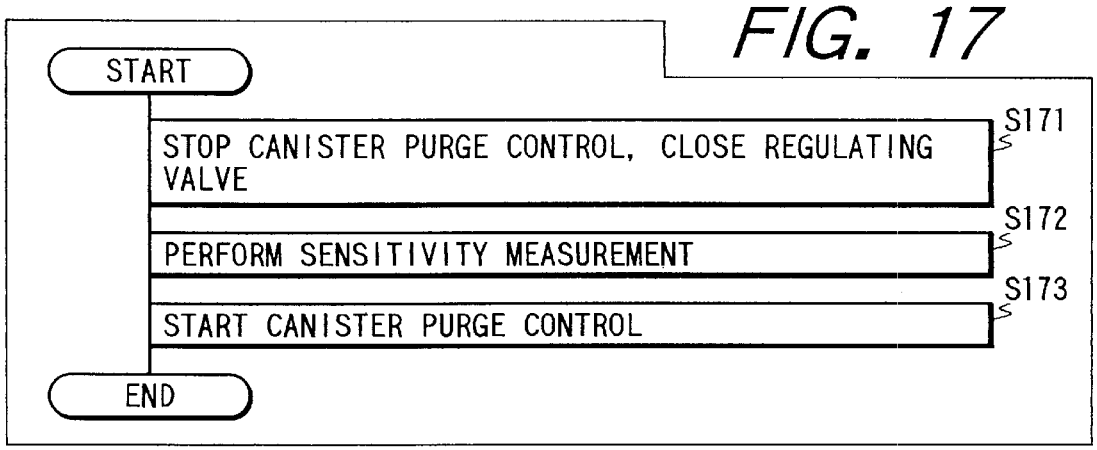
FIG. 17 a schematic operation flowchart for explaining an operation of an air-fuel ratio control system for an internal combustion engine according to a sixteenth preferred embodiment of the present invention.

In FIG. 17, step S171 stops a canister purge control and closes a regulating valve. Then, step S172 performs the sensitivity measurement. Thereafter, step S173 starts the canister purge control.

Accordingly, in the flowchart of FIG. 17, the canister purge valve is closed during the sensitivity measurement. If fuel adsorbed to the canister enters the cylinders during the sensitivity measurement, the measurement error is caused. This can be prevented in this embodiment. Although it is preferable to start the purge control as soon as possible after the engine is started, the sensitivity measurement time is actually no more than 10 seconds. Thus, even if the purge control is stopped during that sensitivity measurement time, no substantial problem is raised.

(Seventeenth Embodiment)

Now, a seventeenth preferred embodiment of the present invention will be described hereinbelow.

An operation of this embodiment will be described with reference to FIG. 18.

Figure 18:
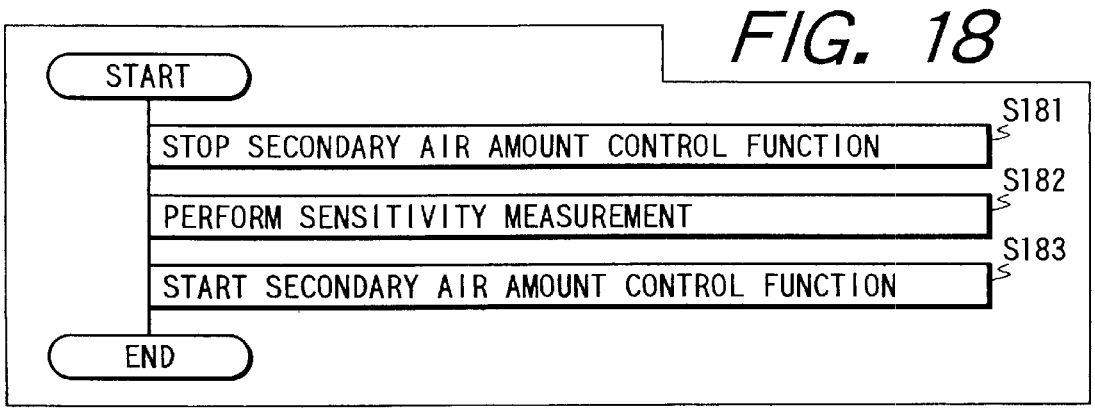
FIG. 18 is a schematic operation flowchart for explaining an operation of an air-fuel ratio control system for an internal combustion engine according to a seventeenth preferred embodiment of the present invention.

In FIG. 18, step S181 stops a secondary air amount control function. Then, step S182 performs the sensitivity measurement. Subsequently, step S183 starts the secondary air amount control function.

In this embodiment, a secondary air amount remains to be constant when performing the sensitivity measurement. A secondary air control is normally performed by the controller which also executes the air-fuel ratio control. Thus, it is easy for the controller to feed a constant instruction amount to an actuator, which controls a secondary air valve, during the sensitivity measurement. Specifically, by stopping the secondary air amount control function, the opening degrees of the secondary air valve are held constant.

In general, the secondary air amount changes due to an idling speed control and others. Accordingly, if this embodiment is applied to the eleventh preferred embodiment (FIG. 12) where the idling state is the essential factor for the sensitivity measurement, the secondary air amount should be also considered as a parameter indicative of the engine operating state if not small in amount. The secondary air amount itself can be derived approximately using the secondary air valve opening degrees. Thus, the problem is raised when the secondary air amount changes during the sensitivity measurement. As described above, in this embodiment, the secondary air amount is controlled to be constant during the sensitivity measurement. Thus, the sensitivity measurement error due to the change in secondary air amount can be effectively prevented.

As appreciated, the injector sensitivity correction in each of the foregoing corresponding preferred embodiments and the LAF sensor sensitivity correction in each of the foregoing corresponding preferred embodiments may be combined to perform both the injector sensitivity correction and the LAF sensor sensitivity correction.

While the present invention has been described in terms of the preferred embodiments, the invention is not to be limited thereto, but can be embodied in various ways without departing from the principle of the invention as defined in the appended claims.

What is claimed is:

1. An air-fuel ratio control system for an internal combustion engine, comprising:

a fuel injector for injecting fuel to the engine;

setting means for sequentially setting fuel injection amounts to be injected from said fuel injector;

measuring means for measuring an accumulated value of fuel amounts actually injected from said fuel injector;

injector sensitivity measuring means for measuring a sensitivity of said fuel injector based on an accumulated value of the fuel injection amounts set by said setting means and the accumulated value of the fuel amounts measured by said measuring means; and injector sensitivity correcting means for correcting the sensitivity of said fuel injector, said injector sensitivity correcting means deriving a sensitivity correction value based on said measured sensitivity of said fuel injector such that a sensitivity of a virtual fuel injector constituted by said fuel injector and said injector sensitivity correcting means becomes equal to a preset injector sensitivity.

2. The air-fuel ratio control system according to claim 1, wherein said injector sensitivity measuring means derives the sensitivity of said fuel injector by dividing the measured accumulated value of the fuel amounts by the accumulated value of said set fuel injection amounts.

3. The air-fuel ratio control system according to claim 1, wherein the sensitivity measurement by said injector sensitivity measuring means and the sensitivity correction by said injector sensitivity correcting means are carried out for each of given engine operating conditions.

4. An air-fuel ratio control system for an internal combustion engine, comprising:

fuel injectors for injecting fuel to corresponding cylinders of the engine;

setting means for sequentially setting fuel injection amounts to be injected from said fuel injectors, respectively;

measuring means for measuring an accumulated value of fuel amounts actually injected from said fuel injectors;

injector sensitivity measuring means for measuring a mean sensitivity of said fuel injectors based on an accumulated value of the fuel injection amounts set by said setting means and the accumulated value of the fuel amounts measured by said measuring means; and injector sensitivity correcting means for correcting the mean sensitivity of said fuel injectors, said injector sensitivity correcting means deriving a sensitivity correction value based on said measured mean sensitivity of said fuel injectors such that a mean sensitivity of virtual fuel injectors each constituted by one of said fuel injectors and said injector sensitivity correcting means becomes equal to a preset injector sensitivity.

5. The air-fuel ratio control system according to claim 4, wherein said injector sensitivity measuring means derives the mean sensitivity of said fuel injectors by dividing the measured accumulated value of the fuel amounts by the accumulated value of said set fuel injection amounts.

6. The air-fuel ratio control system according to claim 4, wherein the mean sensitivity measurement by said injector sensitivity measuring means and the mean sensitivity correction by said injector sensitivity correcting means are carried out for each of given engine operating conditions.

* * * * *